United States Patent [19]

Streeter et al.

[11] Patent Number: 4,542,603

[45] Date of Patent: Sep. 24, 1985

[54] DISPLAY SIGN INCLUDING CHANGEABLE NUMERAL CHARACTERS

[76] Inventors: Bert E. Streeter, 4057 Concord Ave., Eugene, Oreg. 97402; Larry G. Robinson, 660 "E" St., Springfield, Oreg. 97477

[21] Appl. No.: 586,849

[22] Filed: Mar. 6, 1984

[51] Int. Cl.[4] ..... G09F 3/04

[52] U.S. Cl. ..... 40/447; 40/450; 40/486; 40/530; 402/500

[58] Field of Search ..... 40/621, 447, 450, 486, 40/530; 402/500

[56] References Cited

U.S. PATENT DOCUMENTS

| | | | |
|---|---|---|---|
| 680,720 | 8/1901 | Le Lande | 40/618 |
| 3,250,031 | 5/1966 | Bowman | 40/447 |
| 3,304,549 | 2/1967 | Aiken | 40/447 |
| 3,458,944 | 8/1969 | Jimenez | 40/447 |
| 4,063,377 | 12/1977 | Hukill | 40/447 |
| 4,223,464 | 9/1980 | Winrow | 40/450 |
| 4,664,047 | 5/1984 | Ruppert | 40/447 |

*Primary Examiner*—Gene Mancene

*Assistant Examiner*—Wenceslao J. Contreras

*Attorney, Agent, or Firm*—Chernoff, Vilhauer, McClung, Birdwell & Stenzel

[57] ABSTRACT

A sign for displaying prices and other information, in which at least one numeral character is changeable to display any numeral from zero through nine. A plurality of flap members are each pivotably attached to a flat foundation portion of the sign by resilient clips which hold a portion of each flap closely against a flat front side of the foundation member, thus holding the entire flap against the front side of the sign to prevent the flaps from being caught by wind. The flaps can be overturned by use of a tool including a spatula-like end, to display selectively a background colored face of the flap, covering a contrastingly colored portion of the foundation member, or to display the opposite face of the flap, which is of the contrasting color, and uncover the contrastingly colored portion of the foundation member. The spring clips are movable to permit the flap to be overturned, yet resiliently urge the flap against the front side of the foundation member at other times.

7 Claims, 21 Drawing Figures

FIG. 1
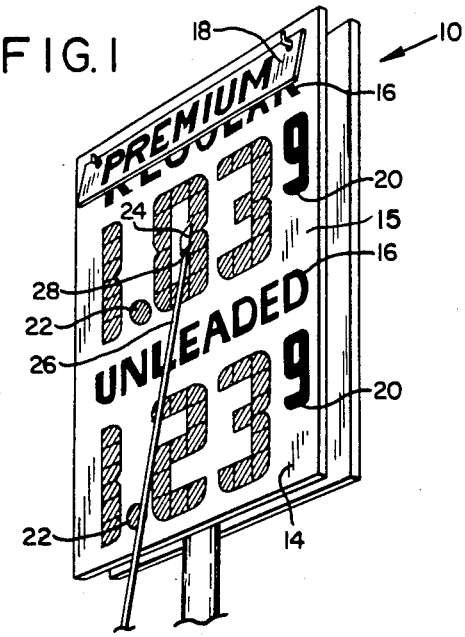
FIG. 2
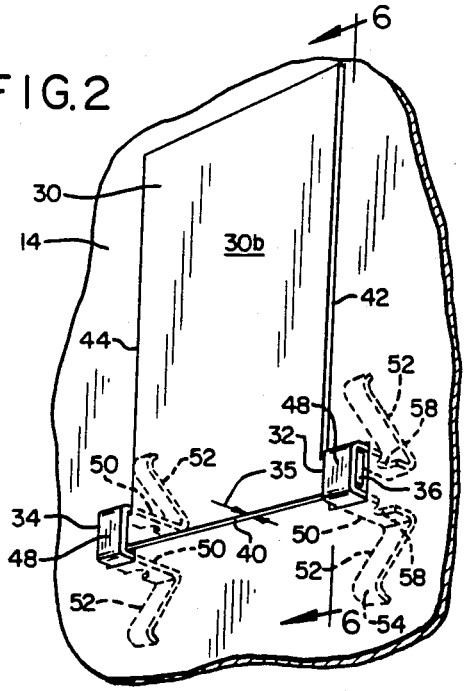
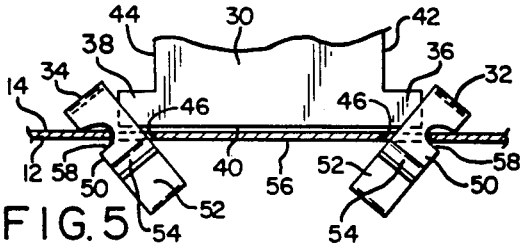
FIG. 5
FIG. 3
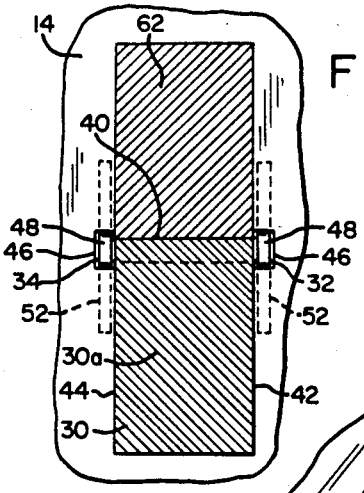
FIG. 4
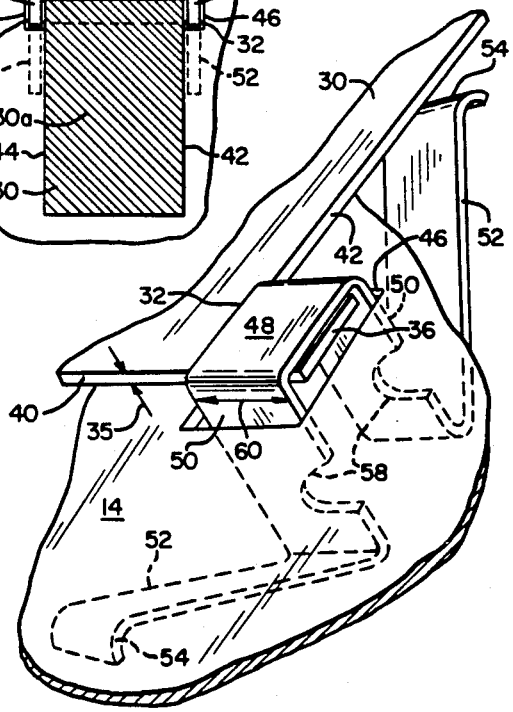
FIG. 6
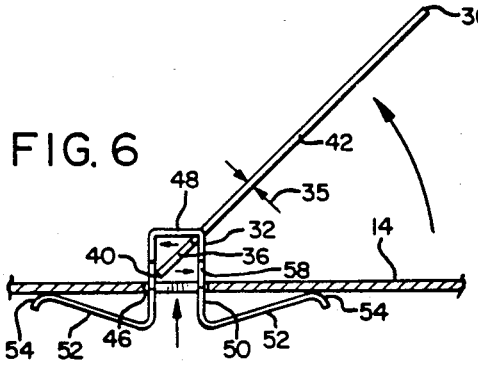
FIG. 7
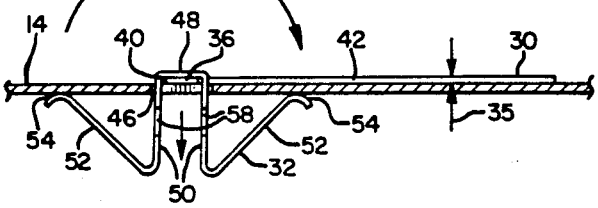

DISPLAY SIGN INCLUDING CHANGEABLE NUMERAL CHARACTERS

BACKGROUND OF THE INVENTION

The present invention is related to devices for changeably displaying numerical characters, and particularly to a sign incorporating movable portions which may be adjusted in particular combinations to display different numeral characters.

Signs are frequently used to display prominently the current prices being charged for products, especially such products as gasoline, diesel fuel, and the like at service stations, and key items such as milk, eggs, and fruit sold at roadside stands and grocery stores. Such signs include numeral characters large enough to be read easily by motorists approaching the service station or roadside stand, etc., in time for them to stop and make purchases.

Previously, such signs have frequently utilized separate numeral characters of sheet material cut to the shape of individual digits, with each digit being detachably mounted on a contrasting background member. Changes in the prices displayed on such signs require removal and replacement of individual digit characters. Thus, for prices up to and including nine dollars and ninety-nine cents ($9.99), twenty-nine separate numeral characters are required in order to be able to display each possible price, and as many separate characters are required for each price which is to be displayed. Such replaceable numeral characters, usually made of rigid plastic sheet material, are subject to being broken, either by being blown off the sign and breaking upon impact with the ground, or as a result of being dropped while advertised prices are being changed. Once broken, a numeral must usually be replaced. As a result, spare numerals must be kept on hand, at substantial expense and requiring safe storage space.

In the case of large signs, the unwieldiness of large plastic numerals makes it difficult to accomplish revision of displayed prices in windy weather. Additionally, changing displays often requires climbing to the sign, making the procedure unsafe during all but dry, calm weather.

Electrically controlled multi-element illuminated signs have become available in recent years, and are convenient to use. Such signs, however, are very expensive to build, operate, and maintain. Except for locations atop tall poles along limited access highways and the like, where prices must be seen at great distances in order to attract motorists to leave the highway, such electrically operated signs are too expensive to be practical.

Previous attempts to provide signs in which numeral or alphabetic characters are defined by combinations of movable elements on a signboard have been shown, for example, in Burnham U.S. Pat. No. 755,272, Jorgensen U.S. Pat. No. 1,357,457, Oelschlaeger U.S. Pat. No. 3,740,878, Giroux U.S. Pat. No. 1,679,520, Dalumi U.S. Pat. Nos. 532,032, 567,379, and 682,177, and Herman German Pat. No. 265,559. These patents show various arrangements for folding or rotating moveable elements of signs to display a contrasting color or a background color at various locations upon a signboard to form various numerals and alphabetic characters. None of these has been entirely satisfactory, however, as evidenced by the lack of their widespread use.

What is needed, therefore, is a more practically changeable numeral display which is easily legible, which is less costly than electrically operated and illuminated signs, which does not require maintenance and storage of a multiplicity of separate characters, and which is relatively immune to being disturbed by wind.

SUMMARY OF THE INVENTION

The present invention provides an improved price display sign including easily changed numerals, for use in advertising prices in a modern, attractive format similar to that of the so-called 7-bar numerals of modern digital display electronic watches and the like.

In a price display sign according to the present invention a foundation member has a substantially planar front side and may be made of sheet metal. For each numeral character, a background area of the foundation member has a background color, and certain areas on the background area are painted a contrasting color. Seven movable flap members are pivotably mounted on the background. Each of the flaps is of the background color on one face, while the other face is of the contrasting color. Special spring clip fasteners attach each flap to the foundation member, normally holding each flap flat against the front surface of the background area, with the chosen face exposed. Turning a flap to expose the contrastingly-colored face simultaneously exposes a contrastingly-colored area of the front side of the sign. By exposing the proper combination of the contrastingly-colored faces of flaps, along with the related contrastingly-colored areas, each of the numeral characters 0–9 may be displayed. Each flap, when turned to show its background-colored face, covers a corresponding contrastingly-colored area of the background element.

Turning each flap of the numeral characters is easily accomplished, even on a large, high signboard, by use of a flexible spatula or similar tool carried on a handle of the appropriate length. Such a tool, made of an appropriately soft, yet stiff, material such as a flexible plastic or synthetic rubber, will enable the numerals of the sign to be changed many times without damage to the flaps or the background area.

Labels giving the names of the most frequently advertised goods, such as "REGULAR" or "UNLEADED," in the case of gasoline, may be painted on the foundation member in a contrasting color. Additional labels indicating other goods may be provided on separate sign-plates attachable removably to cover the painted-on labels.

It is therefore a principal object of the present invention to provide a price display sign whose initial cost and cost of maintenance are lower than for previously used price display signs.

It is another important object of the present invention to provide a price display sign in which it is more convenient to revise the displayed price than in previously available price display signs.

It is an important feature of the present invention that it includes flaps which are attached to a foundation member by retainers and elastic spring clips which permit each flap to be overturned to display the desired face, yet ordinarily hold each flap tightly adjacent the surface of the background member.

It is another important feature of the present invention that it provides a simple font of numeral characters, any of which may be displayed by altering the position of one or more of the hingedly attached flaps to disclose a desired side of each movable flap member.

It is a principal advantage of the present invention that it provides a price display sign which is resistant to damage or alteration of the displayed numerals as a result of wind.

It is another advantage of the present invention that it permits displayed prices to be changed more easily than previously available price display signs.

It is yet a further advantage of the present invention that the changeable elements of numeral characters displayed are not subject to being removed from the sign as a whole and are therefore not subject to being damaged during adjustment of prices displayed.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a perspective view of a price display sign embodying the changeable numerals of the present invention.

FIG. 2 is a perspective view of a portion of the sign shown in FIG. 1, showing the manner in which one of the movable flaps is attached to the foundation member.

FIG. 3 is a view of the portion of a sign shown in FIG. 2, showing the flap turned to its opposite position, exposing the contrastingly-colored face and a contrastingly-colored background area of the sign.

FIG. 4 is a perspective view of a detail of the portion of a sign shown in FIG. 2.

FIG. 5 is a view of the portion of a sign shown in FIG. 2 illustrating the manner of inserting the spring clips which retain the flap on the foundation member.

FIG. 6 is a sectional view of the flap and portion of the background member shown in FIG. 2, taken along line 6—6, showing the flap being turned.

FIG. 7 is a sectional view of the portion of a sign shown in FIG. 2, taken along line 6—6, showing the flap in a different position from that shown in FIG. 6.

DETAILED DESCRIPTION OF THE INVENTION

Figure 8:
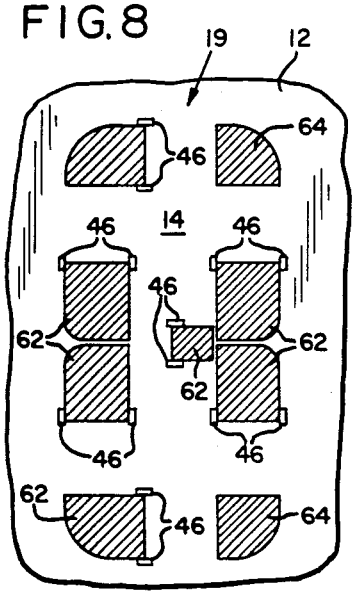
FIG. 8 is a front view of a portion of the background member of a sign according to the invention, showing the pattern of areas of contrasting color provided on the background member for a single numeral character.

Referring now to the drawings, a price display sign 10 according to the invention is shown in FIG. 1. The price display sign 10 comprises a foundation member 12 which is of flat sheet material, such as sheet aluminum, reinforced as necessary for support, depending on the size of the sign 10, to keep the foundation member 12 flat.

The majority of a front side 14 of the foundation member 12 is painted a background color, as a background area 15 for display of price information. An indication of the goods for which prices are displayed may be painted thereon in a contrasting color as, for example, the words "UNLEADED" and "REGULAR" shown at 16. A separately attachable label plate 18 may be utilized to display the name of different goods for which the price is advertised.

A plurality of changeable numeral characters 19 are provided on the sign 10. Depending upon the intended use of the sign, some of the characters may be permanently displayed on the sign 10, as are the smaller numeral figures "9," shown at 20, and as are the decimal points 22.

Each of the large numeral characters 19 is changeable to display any of the characters 0 through 9 by manipulating any of several pivotably attached flap members such as the flap member 24. As will hereinafter be explained more fully, the flap 24 may be turned to display either a first face **24*a* of the same color as the background area 15 or a second face 24*b* (FIG. 10) of a contrasting color, then forms a portion of a numeral character to be displayed. Each flap may be turned to display the desired face by the use of a long handled tool 26 having a flexible paddle 28 at its upper end which can be inserted between the flap and the front side 14 to lift and overturn the flap. The long handled tool 26** includes an adjustably extensible handle, for example, one of aluminum, similar to the extensible handles provided for pruning hooks, window washing tools, and the like, which are conveniently light in weight yet sturdy.

Referring now also to FIGS. 2–7, a typical flap member 30, similar to the flap member 24, is attached to the front side 14 by a pair of spring clips 32 and 34. Preferably the spring clip 32 or 34 is formed of a ribbon-like flat strip of resilient stainless steel material, for the purpose of avoiding corrosion, although other material could also be used. The flap member 30 is, like the foundation member 12, flat and made of sheet material, such as sheet aluminum of an appropriate thickness 35. A pair of retainer portions 36 and 38 are coplanar with the flap 30, preferably being merely lateral extension of the flap 30 along a base edge 40 having the shape of rectangular tabs located along the lateral edges 42 and 44 respectively of the flap 30.

The spring clips 32 and 34 are similar to each other, but are located in opposing positions, each extending through a respective one of a plurality of apertures 46 piercing the foundation member 12 at appropriate locations as will be explained in greater detail below. Each of the spring clips 32 and 34 includes a central portion 48, a pair of rearwardly extending legs 50, and a pair of opposite outwardly extending legs 52. The rearwardly extending legs 50 are preferably generally parallel with one another and perpendicular to the central portion 48. The outwardly extending legs 52 preferably have reversely curved tips 54, which present a convexly curved surface toward the rear side 56 of the foundation member 12.

The apertures 46 are slightly larger than the central portions 48, permitting the spring clips 32 and 34 to slide therethrough in the direction of the legs 56, when the outwardly extending legs 56 are appropriately flexed. A notch 58 is defined in each of the rearwardly extending legs 50. The notches 58 are opposite one another, on the same side of the spring clip 32 or 34. They preferably extend to a depth slightly less than about half the width 60 of the spring clips 32 or 34, and have a width, along the rearwardly extending legs 50 which is somewhat greater than the combined thickness 13 of the flap 30 and the foundation member 12.

The retainer portions 36 preferably extend laterally from the flap 30, beyond its lateral edges 42 and 44 a distance about equal to the width 60 of the respective spring clip 32 or 34. Thus, as shown in FIG. 5, the spring clips 32 and 34 are inserted forwardly from the rear side 56 through the respective aperture 46 toward the front side 14 so that the central portion 48 is spaced forwardly from the front side 14 of the foundation member 12 and the notches 58 are aligned with the edge of the foundation member 12 within the aperture 46. The spring clips 32 and 34 can then be tipped outwardly to a distance providing sufficient clearance between the spring clips 32 and 34 to permit the retainer portions 36 to be placed within the loop defined forwardly of the front side 14 by the central portion 48 and portions of the rearwardly extending legs 50 of each of the spring clips 32 and 34.

Thereafter, moving the spring clips 32 and 34 toward one another and the body of the flap 30 disengages the notches 58 from the edges of the apertures 46, allowing the elasticity of the outwardly extending legs 52 to pull the clips 32 and 34 rearwardly. This movement urges the retainer portions 36, and thus the entire flap member 30, rewardly toward the front side 14 of the foundation member 12, holding the flap 30 closely adjacent and alongside the front side 14. The spring clips 32 and 34 are formed so that with the flap 30 closely adjacent the front side 14 the reversely curved tips 54 of the outwardly extending legs 52 exert a firm pressure against the rear side 56 of the foundation member 12. However, the retainer portions 36 should be sturdy enough not to be bent by the force of the spring clips 32 and 34.

In FIG. 2, the face **30*b* of the flap 30, having the background color of background area 15 of the foundation element 12, is exposed. In FIG. 3 the flap member 30 is shown having been overturned, with its contrastingly colored face 30*a* exposed. Adjacent thereto is a corresponding contrastingly colored portion 62 of the foundation member 12**.

The flap member 30 may be turned over as illustrated in FIGS. 6 and 7. Using an appropriate tool such as the tool 26, if required, the flap is raised from its original position closely adjacent to the front side 14 of the foundation element 12, pivoting about its base edge 40 and sliding the base edge 40 across a portion of the front side 14. The retainer elements 36 pressing against the central portion 48 of the spring clip 32 and 34 raise the spring clips 32 and 34 against the face exerted by the outwardly extending legs 52, pulling the rearwardly extending legs 50 forwardly through the apertures 46. Once the flap 20 has been turned beyond perpendicularity with the foundation member 12 to expose the desired side **30*a* or 30*b*, the resilient biasing force exerted by the curved end portions 54 against the rear side 56 of the foundation element 12 pull the retainer portions 36 toward the front side 14 of the foundation element 12 and thus pull the flap member 30 to a position closely adjacent and alongside the front side 14**.

Figure 9:
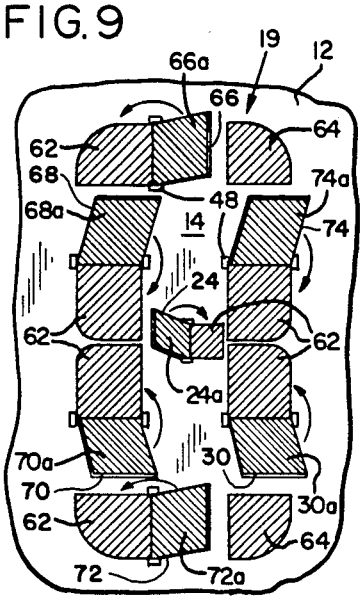
FIG. 9 is a front view of a portion of a sign according to the invention showing the locations of the several movable flaps for one numeral character.
Figure 10:
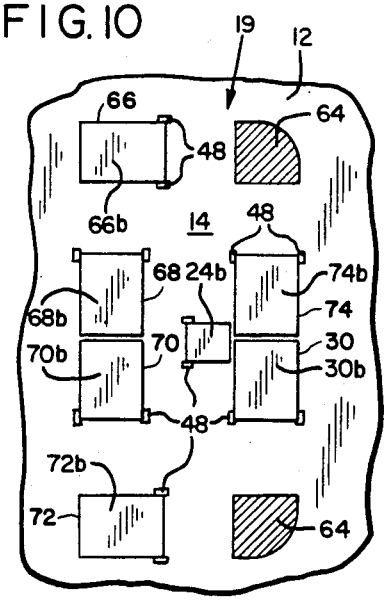
FIG. 10 is a front view similar to FIG. 9 showing a sign according to the present invention, with each of the flaps turned to show the background-colored face.
Figure 12:
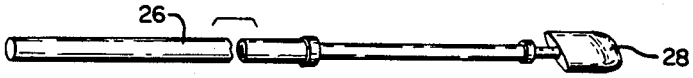
FIG. 12 is view of the tool used to rotate the flap elements.

Each individual numeral character 19 in a changeable sign 10 according to the present invention includes at least a part of the background area 15 of the foundation element 12 which is of a background color, for example, white. As shown in FIGS. 8, 9, and 10, various areas 62 and 64 on the are of a contrasting color. The two contrastingly colored corner areas 64 form the upper right and lower right corners of each numeral character 19 formed according to the invention, while the contrastingly colored areas 62 are exposed to view in display of some numeral characters but may be covered by a movable flap such as the movable flap 30, in formation of other numeral characters.

A pair of apertures 46 is provided adjacent each of the contrastingly colored areas 62, as shown in FIG. 8. Referring now to FIG. 9, a flap element 66 pivotable about a vertical axis, is attached at the top of the numeral character 19. A flap element 68, pivotable about a horizontal axis, is attached at the upper left side of the character 19. A flap element 70, pivotable about a vertical axis, is attached adjacent the lower left side, and a flap 72, pivotable about a vertical axis, is attached at the bottom of the character 19. The flap 24, pivotable about a vertical axis, is attached centrally within the numeral character 19. The flap 30 and a flap 74, both pivotable about horizontal axes, are located respectively at the lower and upper portions of the right side of the Character 19. All of the flaps 30, 66, 68, 70, 72, 74 are similar to each other, and the flap 24 is similar, as well, except for its somewhat smaller size.

Thus, as may be seen in FIG. 10, when all of the flaps 24, 30, 66, 68, 70, 72, and 74 are turned to show their background-colored faces **24*b*, 30*b*, 66*b*, 68*b*, 70*b*, 72*b*, and 74*b*, only the two contrastingly colored corner areas 64 are left exposed, and all of the contrastingly colored areas 62 (FIG. 8**) are covered by the movable flaps.

Each of the numeral characters 1 through 9 and 0 may be formed by turning appropriate ones of the flaps to expose the contrastingly colored face of each flap and simultaneously expose the corresponding contrastingly colored corner areas 64 of the foundation element 12, as illustrated in FIGS. 11A–11J. Thus the numeral "1" is formed bY turning the upper and lower right side flaps 74 and 30 to display their contrastingly colored faces **74*a* and 30*a*, leaving the other flaps turned to show their background-colored faces and simultaneously cover the corresponding contrastingly colored areas 62 on the foundation element 12**.

Figure 11:
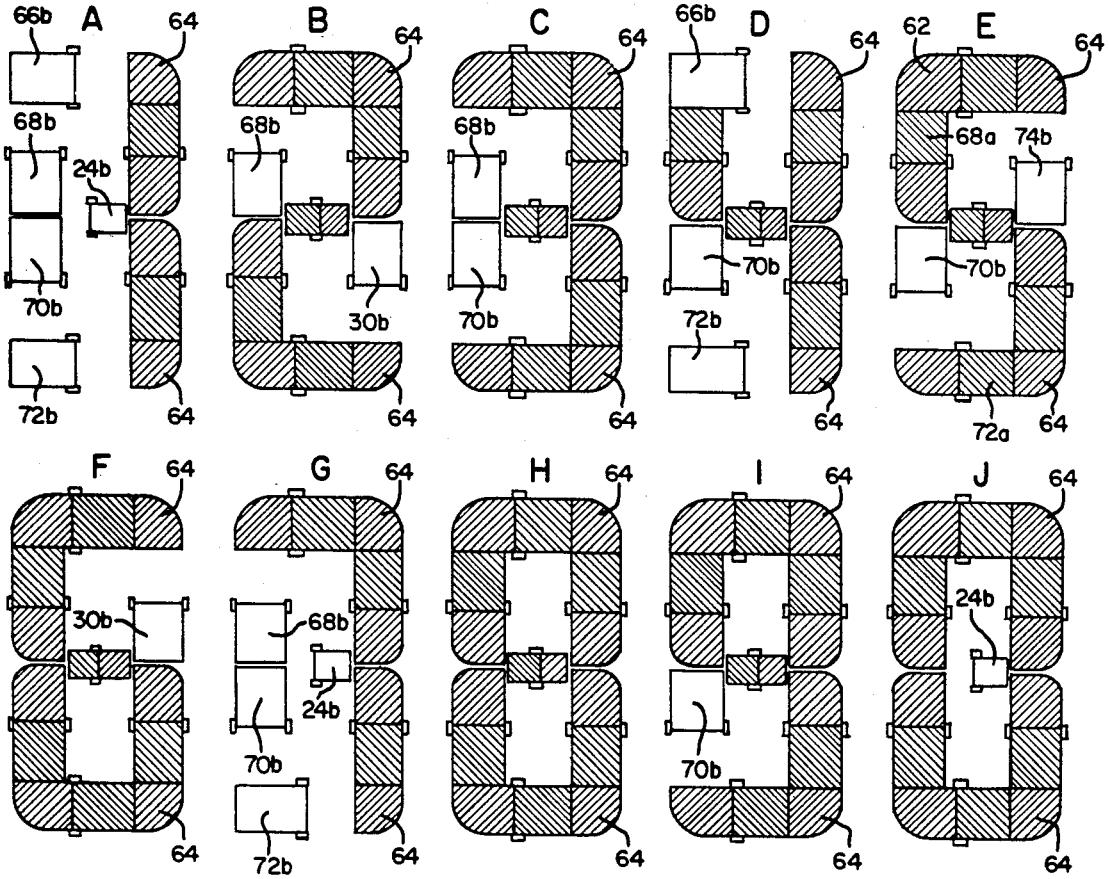
FIGS. 11A–11J show the combinations of flap positions required to display each of the numeral characters 1–9 and 0 in a changeable numeral character according to the present invention.

The numeral character "2" is displayed by exposing the background colored face **68*b* of the upper left flap 68, and the background colored face 30*b* of the lower right side flap 30, exposing the contrastingly colored faces and the corresponding contrasting colored areas 62 of the foundation element 12 in the case of each of the other movable flaps of the changeable numeral character 19, as shown in FIG. 11B. Each of the remaining numerals 3–9 and 0 is formed similarly by displaying a combination of exposed background faces and contrastingly colored faces of flaps and contrastingly colored areas 62** as shown in the following table:

TABLE I

| Numeral Character To Be Displayed | Contrastingly-Colored Flap Faces Exposed | Background Colored Flap Faces Exposed |
|---|---|---|
| 1 (FIG. 11A) | Upper right side 74a and lower right side 30a | Top 66b<br>Upper left side 68b<br>Center 24b<br>Lower left side 70b<br>Bottom 72b |
| 2 (FIG. 11B) | Top 66a, Upper right 74a, center 24a, lower left 70a, bottom 72a | Upper left 68b, Lower right 30b |
| 3 (FIG. 11C) | Top 66a, upper right 74a, center 24a, lower right 30a, bottom 72a | Upper left 68b, Lower left 70b |

TABLE I-continued

| Numeral Character To Be Displayed | Contrastingly-Colored Flap Faces Exposed | Background Colored Flap Faces Exposed |
|---|---|---|
| 4 (FIG. 11D) | Upper left 68a, center 24a, upper right 74a, lower right 30a | Top 66b, lower left 70b, bottom 72b |
| 5 (FIG. 11E) | Top 66a, upper left 68a, center 24a, lower right 30a, bottom 72a | Lower left 70b, upper right 74b |
| 6 (FIG. 11F) | Top 66a, upper left 68a, lower left 70a, bottom 72a, lower right 30a, center 24a | Upper right 74b |
| 7 (FIG. 11G) | Top 66a, upper right 74a, lower right 30a | Upper left 68b, lower left 70b, bottom 72b, center 24b |
| 8 (FIG. 11H) | All | None |
| 9 (FIG. 11I) | Top 66a, upper left 68a, center 24a, upper right 74a, lower right 30a, bottom 72a | Lower left 70b |
| 0 (FIG. 11J) | Top 66, upper left 68a, lower left 70a, bottom 72a, lower right 30a, upper right 74a | Center 24b |

Thus it will be appreciated that changing from any numeral to another requires no more than six flaps to be turned over, and most changes from one numeral to any other numeral require fewer than five flaps to be turned.

The terms and expressions which have been employed in the foregoing specifiation are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A sign for displaying numerical information including a changeable numeral character, comprising:

(a) a foundation member having a front side and a rear side and defining a background area of a background color on said front side and a plurality of apertures extending therethrough from said rear side to said front side;

(b) a plurality of flaps, each attached to said foundation member on said front side thereof in a respective location and each having a first face of said background color and second face of a second color different from said background color;

(c) means for attaching each of said flaps to said foundation member within said background area, said means for attaching including at least one retainer portion associated with each said flap and a respective spring clip extending through one of said apertures defined in said foundation member and around each retainer portion of said flap, resiliently urging said retainer portion of said flap toward a position in which said retainer portion is adjacent said front side parallel with said background area;

(d) each said spring clip including a central section, a pair of rearwardly-extending legs connected with said central section and extending approximately perpendicularly rearwardly therefrom, each having an outer end remote from said central section and an outwardly extending leg attached thereto and extending divergently forward alongside said rearwardly-extending leg, each said spring clip having said central section located on said front side of said foundation member and said outwardly extending legs located on said rear side thereof and resiliently pressing against said rear side;

(e) a plurality of areas of said second color, each corresponding to a respective one of said flaps and located on said foundation member where a respective one of said flaps covers said area when said first face of said respective one of said flaps is exposed and exposes said area when said second face of said flap is exposed.

2. The sign of claim 1 wherein each said flap is generally rectangular and includes a pair of adjacent corners and a pair of retainer portions extending respectively in opposite directions from said adjacent corners, wherein said foundation member is of sheet material having a predetermined thickness and said spring clip is of elongate flat resilient material having a pair of opposite longitudinal edges, said rearwardly extending legs, outwardly extending legs and central section being defined by bends in said elongate flat resilient material.

3. The sign of claim 1 wherein said front side of said foundation member is generally vertical and said numeral character has a top and a bottom, a left side and a right side, and upper and lower right corners, said sign including a first flap having a horizontal pivot axis located between said upper right corner and mid-height of the right side of said character, a second flap having a horizontal pivot axis located on said right side between said lower right corner and mid-height of said numeral character; a third flap having a vertical pivot axis located centrally within said numeral character; a fourth flap having a vertical pivot axis located at the top of said numeral character; a fifth flap having a vertical pivot axis, located at the bottom of said numeral character; a sixth flap having a horizontal pivot axis located on the left side above mid-height of said numeral character; and a seventh flap having a horizontal pivot axis located on said left side below mid height of said numeral character.

4. The sign of claim 1 wherein said foundation member and each of said flaps are of generally planar sheet material and said flaps lie closely against said front side of said foundation element in displaying each of said numeral characters.

5. A sign including a changeable numeral character display, comprising:

(a) a foundation member having a flat background area;

(b) a plurality of movable flaps each having a pair of faces and means for defining a baseline beyond which none of said flap extends;

(c) a retainer associated with each of said movable flaps, each said retainer having an edge located parallel to said baseline and spaced a predetermined distance away from said baseline;

(d) a spring clip of resiliently flexible ribbon-shaped material having a width dimension and a thickness dimension, said spring clip including a central section, a pair of generally parallel rearwardly extending legs, separated from each other by at least said predetermined distance and each longer than said predetermined distance, and a pair of opposite outwardly extending legs, each having a forwardly convexly arcuate bearing portion, said rearwardly extending legs each having an end attached to said central section and said outwardly extending legs being connected with said rearwardly extending legs; and (e) said foundation member defining in association with each movable flap at least one aperture extending therethrough, said spring clip extending through said aperture and holding said movable flap against said front side of said foundation member by extending around said retainer of said movable flap.

6. The sign of claim 5 wherein each said movable flap includes a pair of oppositely located lateral edges and one of said retainers extends from each of said oppositely located lateral edges, each said movable flap having a base edge defining said baseline.

7. The sign of claim 5 including seven of said flaps, wherein said foundation member has a background color and a plurality of contrastingly-colored portions, each said flap covering a respective one of said contrastingly colored portions of said foundation member when in a position adjacent and parallel with said background member and exposing a background-colored one of said pair of faces thereof, and exposing said respective contrastingly colored portion of said foundation member when located so as to expose a contrastingly colored one of said pair of faces thereof.

* * * * *